US007980275B2

(12) United States Patent
Gstrein et al.

(10) Patent No.: US 7,980,275 B2
(45) Date of Patent: Jul. 19, 2011

(54) PAPERMAKER'S PRESS FELT WITH LONG MACHINE DIRECTION FLOATS IN BASE FABRIC

(75) Inventors: Hippolit Gstrein, Gloggnitz (AT); Klaus Haiden, Neunkirchen (AT)

(73) Assignee: Huyck Austria GmbH, Gloggnitz (AT)

( * ) Notice: Subject to any disclaimer, the term of this patent is extended or adjusted under 35 U.S.C. 154(b) by 0 days.

(21) Appl. No.: 12/485,329

(22) Filed: Jun. 16, 2009

(65) Prior Publication Data

US 2009/0253326 A1 Oct. 8, 2009

Related U.S. Application Data

(63) Continuation of application No. 12/211,880, filed on Sep. 17, 2008, which is a continuation of application No. 11/095,008, filed on Mar. 31, 2005, now abandoned, which is a continuation-in-part of application No. 11/084,899, filed on Mar. 21, 2005, now abandoned.

(51) Int. Cl.
*D03D 3/04* (2006.01)
*D21F 7/08* (2006.01)
*D03D 25/00* (2006.01)

(52) U.S. Cl. ..... 139/383 AA; 139/383 R; 139/383 A; 162/358.1

(58) Field of Classification Search ..... 139/383 A; 162/358.2, 900; 442/205, 203
See application file for complete search history.

(56) References Cited

U.S. PATENT DOCUMENTS

| | | | | |
|---|---|---|---|---|
| 4,105,495 | A | 8/1978 | Pal | |
| 4,187,618 | A | 2/1980 | Diehl | |
| 4,323,622 | A | 4/1982 | Gladh et al. | |
| 4,425,392 | A | 1/1984 | Oikawa et al. | |
| 4,461,803 | A | 7/1984 | Booth et al. | |
| 4,503,113 | A | 3/1985 | Smart | |
| 4,515,853 | A * | 5/1985 | Borel | 442/205 |
| 4,564,052 | A * | 1/1986 | Borel | 139/425 A |
| 4,564,985 | A | 1/1986 | Tanabe | |
| 4,592,395 | A * | 6/1986 | Borel | 139/383 A |
| 4,632,716 | A | 12/1986 | Smith | |

(Continued)

FOREIGN PATENT DOCUMENTS

EP 0549917 A1 7/1993

(Continued)

OTHER PUBLICATIONS

Japanese Office Action for Application No. 2006-078193 dispatched on Apr. 17, 2009.

(Continued)

*Primary Examiner* — Bobby H Muromoto, Jr.
(74) *Attorney, Agent, or Firm* — Myers Bigel Sibley & Sajovec

(57) ABSTRACT

A papermaker's press felt includes: a base fabric, comprising: a set of top machine direction (MD) yarns; a set of bottom MD yarns; and a set of cross machine direction (CMD) yarns interwoven with the top MD yarns and the bottom MD yarns. The top MD yarns, bottom MD yarns, and CMD yarns are interwoven in a series of repeat units in which each top MD yarn forms a long MD paper side float above certain consecutive ones of the set of CMD yarns. The press felt further comprises at least one batt layer attached to the base fabric. In this configuration, the long paper side floats of the base fabric can provide a desirable balance of properties.

12 Claims, 14 Drawing Sheets

U.S. PATENT DOCUMENTS

| | | | | | |
|---|---|---|---|---|---|
| 4,739,803 | A | * | 4/1988 | Borel | 139/383 A |
| 4,759,975 | A | | 7/1988 | Sutherland et al. | |
| 4,784,190 | A | * | 11/1988 | Mullaney | 139/383 A |
| 4,815,503 | A | * | 3/1989 | Borel | 139/383 A |
| 4,839,220 | A | | 6/1989 | Stijntjes et al. | |
| 4,928,737 | A | * | 5/1990 | Borel | 139/383 A |
| 4,982,766 | A | * | 1/1991 | Taipale et al. | 139/383 A |
| 5,089,324 | A | * | 2/1992 | Jackson | 442/195 |
| 5,094,719 | A | * | 3/1992 | Fry | 162/358.2 |
| 5,110,672 | A | * | 5/1992 | Zehle et al. | 442/240 |
| 5,135,802 | A | * | 8/1992 | Gstrein et al. | 442/206 |
| 5,277,967 | A | * | 1/1994 | Zehle et al. | 442/206 |
| 5,343,896 | A | * | 9/1994 | Schroder et al. | 139/383 A |
| 5,368,696 | A | | 11/1994 | Cunnane et al. | |
| 5,411,062 | A | | 5/1995 | Lee | |
| 5,476,123 | A | | 12/1995 | Rydin | |
| 5,549,967 | A | * | 8/1996 | Gstrein | 442/200 |
| 5,601,120 | A | | 2/1997 | Kuckart et al. | |
| 5,618,612 | A | * | 4/1997 | Gstrein | 442/189 |
| 5,787,936 | A | | 8/1998 | Snipes | |
| 5,799,709 | A | | 9/1998 | Shipley | |
| 5,806,569 | A | * | 9/1998 | Gulya et al. | 139/383 A |
| 5,853,547 | A | * | 12/1998 | Ahrens et al. | 162/348 |
| 5,891,516 | A | * | 4/1999 | Gstrein et al. | 427/189 |
| 5,913,339 | A | | 6/1999 | Lee | |
| 5,975,149 | A | * | 11/1999 | Lee et al. | 139/383 A |
| 6,000,440 | A | * | 12/1999 | Hay | 139/383 A |
| 6,000,441 | A | | 12/1999 | Lee et al. | |
| 6,110,324 | A | * | 8/2000 | Trokhan et al. | 162/358.2 |
| 6,175,996 | B1 | * | 1/2001 | Gstrein et al. | 28/114 |
| 6,378,566 | B1 | | 4/2002 | Kornett | |
| 6,383,339 | B1 | * | 5/2002 | Gstrein | 162/358.4 |
| 6,616,812 | B2 | * | 9/2003 | Beck | 162/358.2 |
| 6,699,367 | B2 | * | 3/2004 | Gstrein et al. | 162/358.2 |
| 6,708,732 | B1 | * | 3/2004 | Hay et al. | 139/383 A |
| 6,763,855 | B2 | * | 7/2004 | Rougvie | 139/383 A |
| 6,810,917 | B2 | * | 11/2004 | Stone | 139/383 A |
| 6,837,276 | B2 | * | 1/2005 | Josef et al. | 139/383 A |
| 7,059,361 | B1 | * | 6/2006 | Hansson | 139/383 A |

FOREIGN PATENT DOCUMENTS

| | | |
|---|---|---|
| JP | 04-153390 | 5/1992 |
| JP | 06-146191 | 5/1994 |
| WO | WO 93/01350 | 1/1993 |
| WO | WO 93/09942 | 5/1993 |

OTHER PUBLICATIONS

Second Office Action from the Chinese Patent Office for Patent Application 2006/10068233.0 mailed on Jul. 30, 2010.

* cited by examiner

PAPERMAKER'S PRESS FELT WITH LONG MACHINE DIRECTION FLOATS IN BASE FABRIC

RELATED APPLICATION

This application is a continuation of and claims priority from U.S. patent application Ser. No. 12/211,880, filed Sep. 17, 2008, which is a continuation of U.S. application Ser. No. 11/095,008, filed Mar. 31, 2005 entitled Papermaker's Press Felt With Long Machine Direction Floats in Base Fabric, which is a continuation-in-part of U.S. patent application Ser. No. 11/084,899, filed Mar. 21, 2005, entitled Papermaker's Press Felt With Long Machine Direction Floats in Base Fabric, the disclosures of which are hereby incorporated herein in their entireties.

FIELD OF THE INVENTION

The present invention relates generally to papermaking, and more particularly to fabrics used in papermaking.

BACKGROUND OF THE INVENTION

In the conventional fourdrinier papermaking process, a water slurry or suspension of cellulosic fibers (known as the paper "stock") is fed onto the top of the upper run of an endless belt of woven wire and/or synthetic material that travels between two or more rollers. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of press rolls covered with another fabric, typically referred to as a "press felt." Pressure from the rolls removes additional moisture from the web; the moisture removal is often enhanced by the presence of a "batt" layer on the press felt. The paper is then conveyed to a drier section for further moisture removal. After drying, the paper is ready for secondary processing and packaging.

Press felts typically include one or more base fabric layers along with one or more batt layers. The base fabrics can be single or multilayer designs, although recently conventional fabrics have often been replaced with laminated fabric designs, which can include, for example, a fine top fabric for enhanced pressure transfer uniformity and a more open bottom fabric design for improved dewatering. Most commonly, laminated base fabrics comprise two single layer fabrics needled together, although double layer fabrics may also be used. Even three or more fabric layers may be employed in some fabrics (see, e.g., U.S. Pat. No. 5,277,967 to Zehle et al., the disclosure of which is hereby incorporated herein in its entirety). These fabrics have typically been woven on 12 and 16 shed patterns such as plain weaves or twills or 6 harness satins. However, these fabrics often suffer from increased start-up time.

Other advances in press felt design have incorporated non-woven base layers. Exemplary of these are spiraled fabrics, such as those described in U.S. Pat. No. 6,240,608 and U.S. Patent Publication No. 20040005833, the disclosures of each of which are hereby incorporated herein by reference in their entireties. Non-woven fabrics can enjoy as an advantage the absence of a knuckle on the top surface of the fabric that can negatively impact paper marking. However, these fabrics can tend to suffer from hydraulic marking and collapsing under high loadings.

In view of the foregoing, it would be desirable to provide a base fabric for a press felt that overcomes some of the shortcomings of spiraled fabrics at a lower start-up period than a laminated base fabric.

SUMMARY OF THE INVENTION

The present invention can overcome some of the shortcomings of prior press felts. As a first aspect, embodiments of the present invention are directed to a papermaker's press felt, comprising: a base fabric, comprising: a set of top machine direction (MD) yarns; a set of bottom MD yarns; and a set of cross machine direction (CMD) yarns interwoven with the top MD yarns and the bottom MD yarns. The top MD yarns, bottom MD yarns, and CMD yarns are interwoven in a series of repeat units in which each top MD yarn forms a long MD paper side float above certain consecutive ones of the set of CMD yarns. The press felt further comprises at least one batt layer attached to the base fabric. In this configuration, the long paper side floats of the base fabric can provide a desirable balance of properties.

As a second aspect, embodiments of the present invention are directed to a papermaker's press felt, comprising: a base fabric, comprising: a set of top machine direction (MD) yarns; a set of intermediate MD yarns; a set of bottom MD yarns; a set of upper cross machine direction (CMD) yarns interwoven with the top MD yarns and the intermediate MD yarns; and a set of lower CMD yarns interwoven with the intermediate MD yarns and the bottom MD yarns. The top MD yarns, intermediate MD yarns, bottom MD yarns, upper CMD yarns and lower CMD yarns are interwoven in a series of repeat units in which each top MD yarn forms a long MD paper side float above certain consecutive ones of the top CMD yarns. The press felt further comprises at least one batt layer attached to the base fabric. Again, this configuration can provide a desirable balance of properties to the base fabric.

DETAILED DESCRIPTION OF EMBODIMENTS OF THE INVENTION

Figure 1:
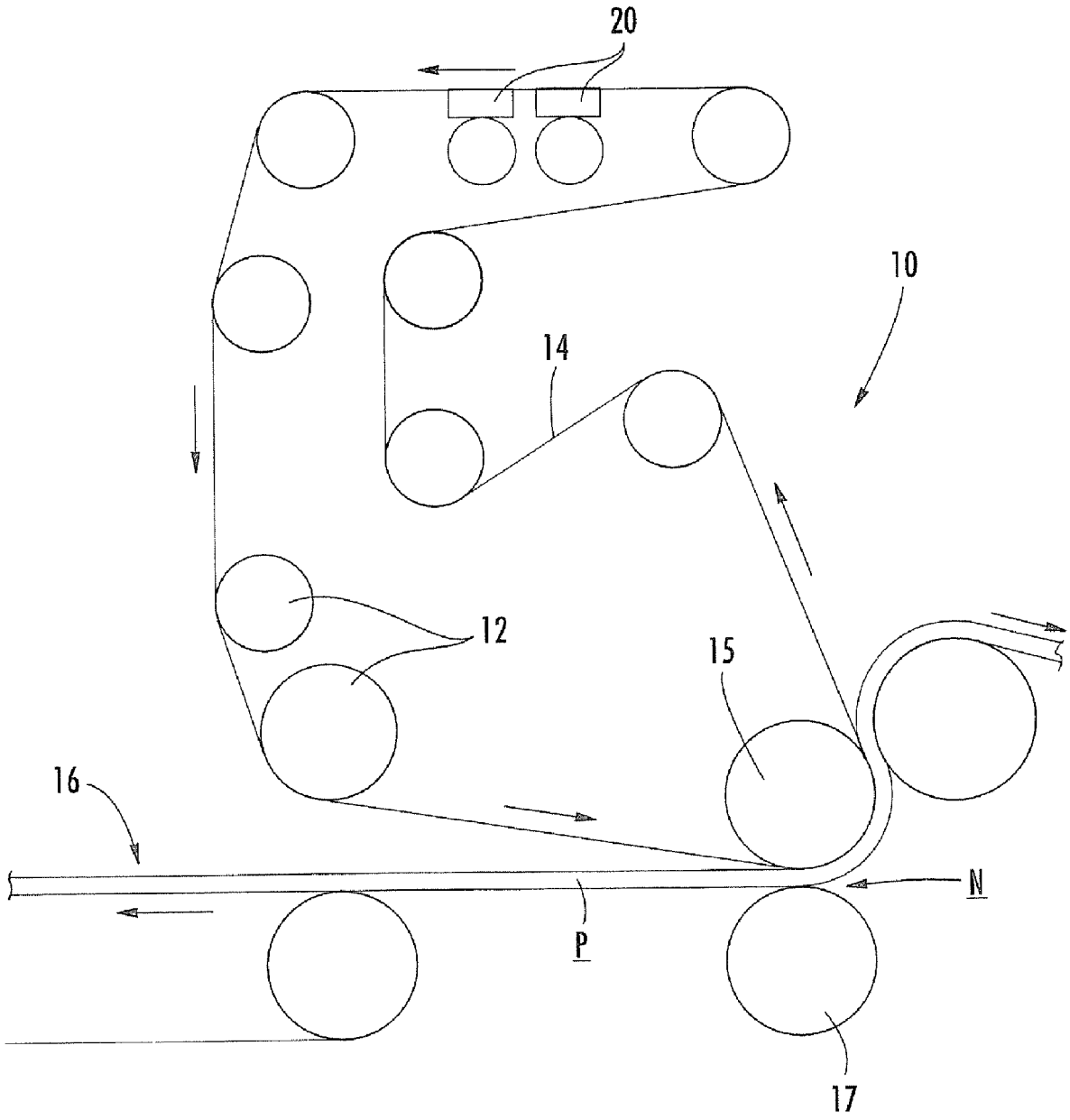
FIG. 1 is a schematic diagram illustrating the press section of a papermaking machine that may employ a press felt according to embodiments of the present invention.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

As used herein, the terms "machine direction" (MD) and "cross machine direction" (CMD) refer, respectively, to a direction aligned with the direction of travel of the papermakers' fabric on a papermaking machine, and a direction parallel to the fabric surface and transverse to the direction of travel. Also, both the flat weaving and endless weaving methods described hereinabove are well known in this art, and the term "endless belt" as used herein refers to belts made by either method.

Referring now to the figures, a papermaking machine press section, designated broadly at 10, is illustrated in FIG. 1. The press section 10 includes a press felt 14 that is installed upon and conveyed by a set of rolls 12. In its travel, the felt 14 travels over a press roll 15. An opposed press roll 17 is positioned so that, in conjunction with the felt 14 and press roll 15, it forms a nip N between the press rolls 15 and 17.

In operation, a paper web P is conveyed from a forming section 16 through the nip N formed by the press rollers 15, 17, wherein pressure is applied to the paper web P by the press rolls 15, 17. The pressure forces moisture from the paper web P that is absorbed by the felt 14. As the felt 14 is conveyed around its roll set 12, moisture is removed from the felt 14 and conditioned by one or more suction boxes 20.

Figure 2:
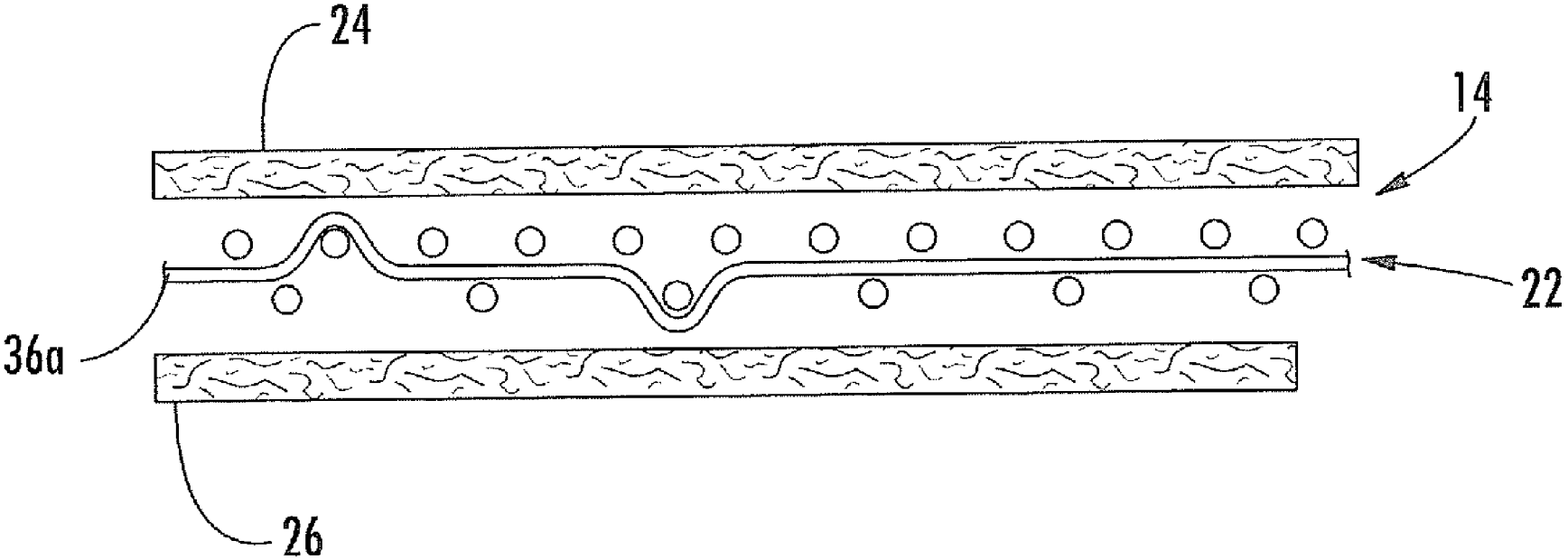
FIG. 2 is a cross-sectional view of a press felt according to embodiments of the present invention.

FIG. 2 illustrates a cross-section of the felt 14. As can be seen in the aforementioned figures, the felt 14 includes a base fabric layer 22 (described in much greater detail below) and two batt layers: a machine side batt layer 24 and a paper side batt layer 26. Illustratively and preferably, these batt layers 24, 26 are attached to the base fabric layer 22 through a needling process, although other attachment techniques, such as heat bonding and adhesives, can also be used with the present invention. The machine side and paper side batt layers 24, 26 should be formed of material, such as a synthetic fiber like acrylic, aramid, polyester, or nylon, or a natural fiber such as wool, that assists in wicking water away from the base fabric layer 22. Preferred materials for the batt layers 24, 26 include polyamide, polyester and blends thereof. The weight and thickness of the batt layers 24, 26 can vary, although it is preferable that the ratio of batt weight to fabric weight is about between about 0.5 and 2.0, with 1.0 being more preferred. Also, in some embodiments, it may be desirable to have additional batt layers or to omit either or both of the batt layers 24, 26.

Figure 3:
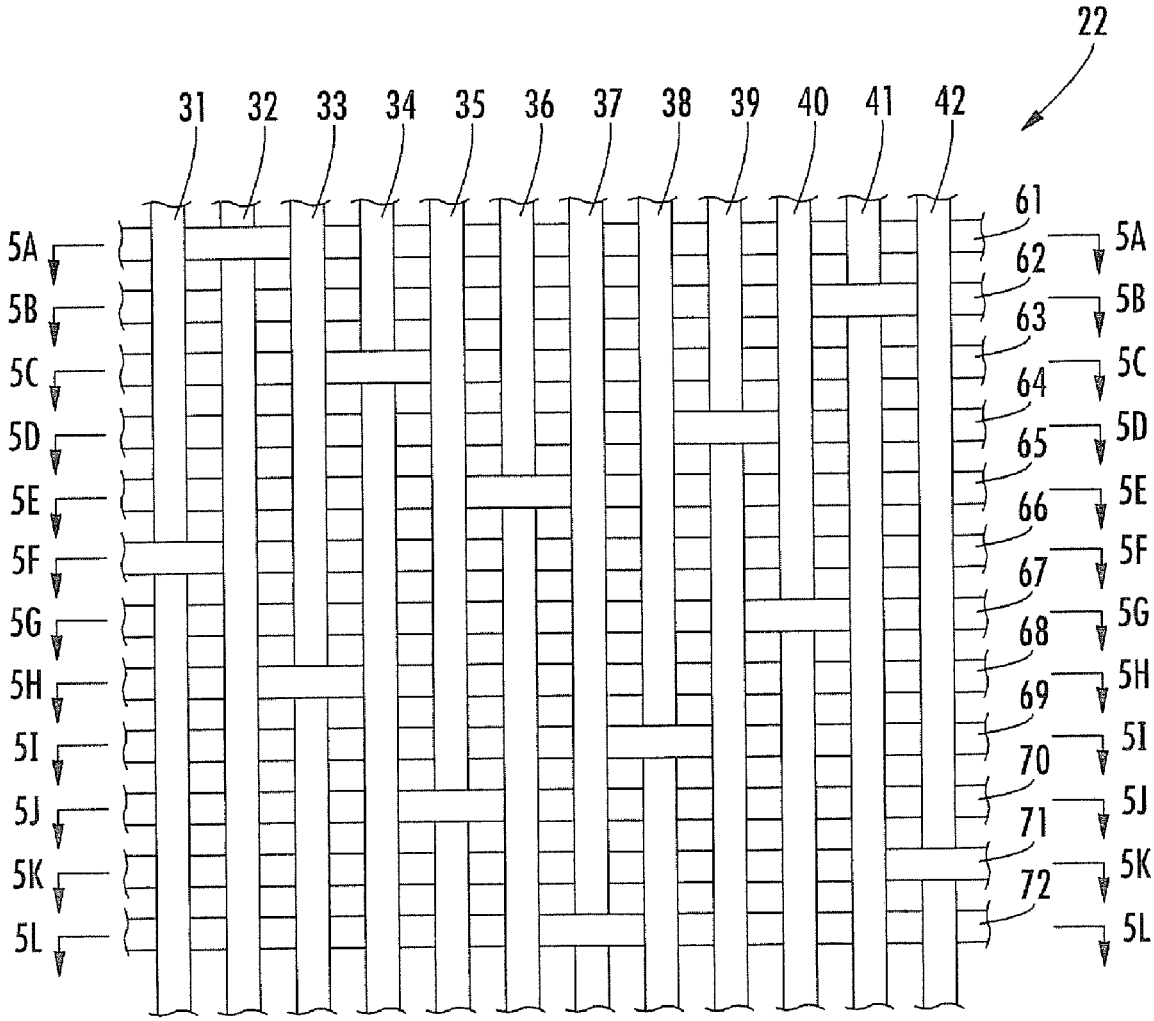
FIG. 3 is a top view of a base fabric of the press felt of FIG. 1.
Figure 4:
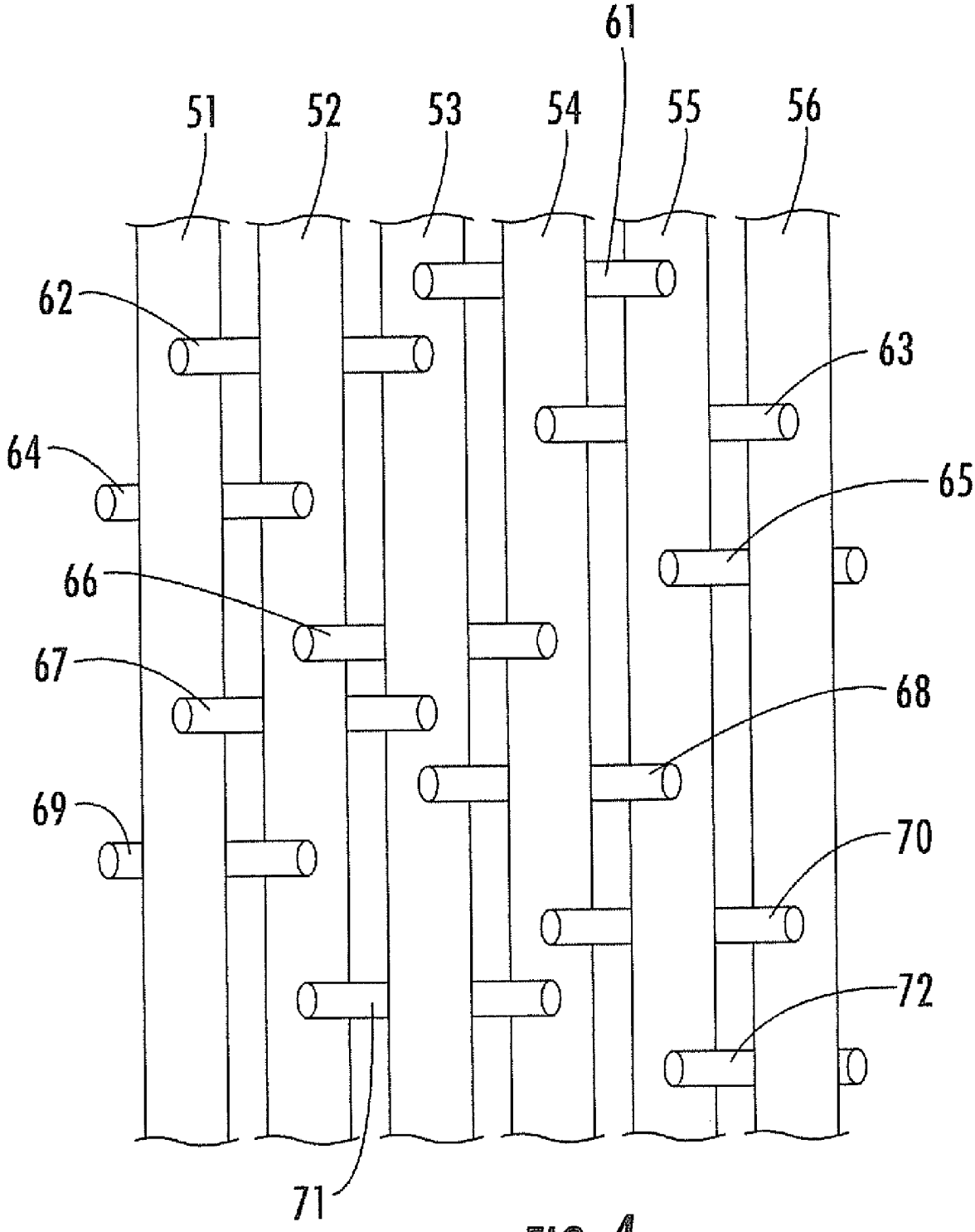
FIG. 4 is a top view of the bottom layer of the base fabric of FIG. 3.
Figure 5A:
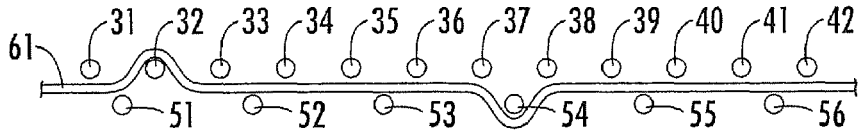
FIGS. 5A-5L are section views taken along lines 5A-5A through 5L-5L of FIG. 3.
Figure 5B:
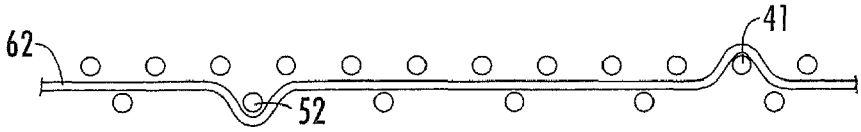
Figure 5C:
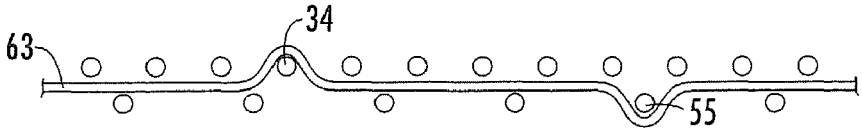
Figure 5D:
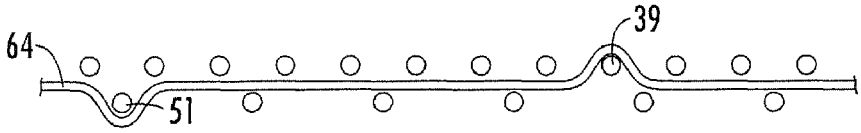
Figure 5E:
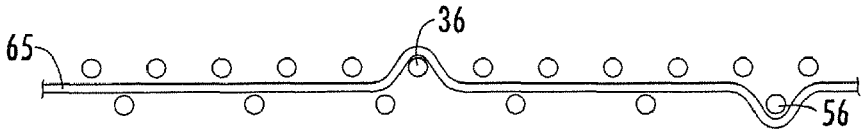
Figure 5F:
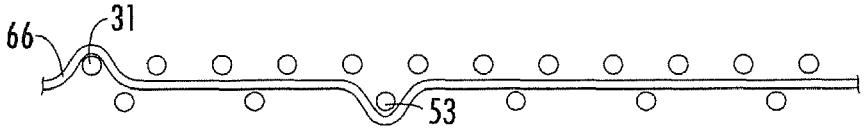
Figure 5G:
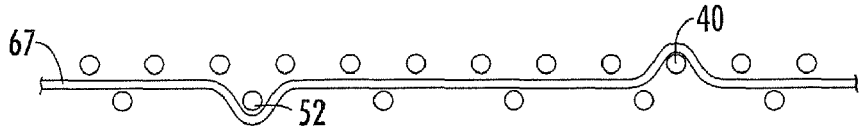
Figure 5H:
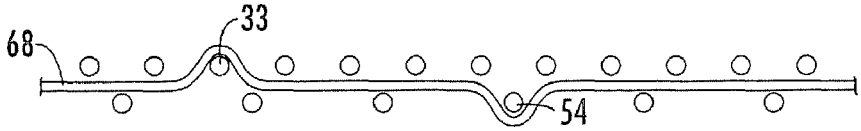
Figure 5I:
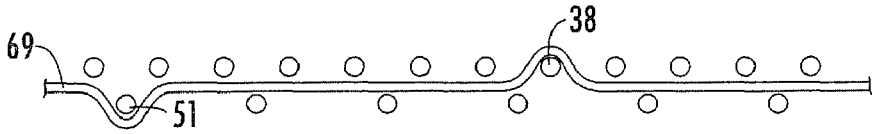
Figure 5J:
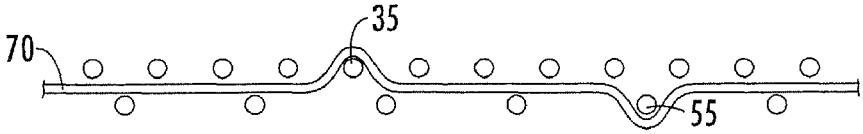
Figure 5K:
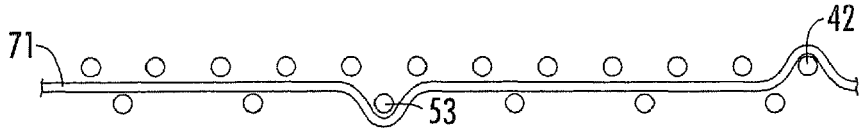
Figure 5L:
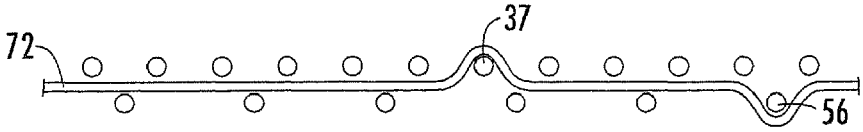

FIG. 3 illustrates a repeat unit of the top, or papermaking, surface of the duplex base fabric 22, and FIG. 4 illustrates a corresponding repeat unit the bottom layer of the base fabric 22 as seen from above. The base fabric 22 includes twelve top MD yarns 31-42, six bottom MD yarns 51-56, and twelve CMD yarns 61-72. The interweaving of these yarns is described below.

As can be seen in FIGS. 5A-5L, each of the CMD yarns 61-72 interweaves in an "over 1/under 11" pattern with respect to the top MD yarns 31-42. For example, CMD yarn 66 passes over top MD yarn 31, then passes below each of the other top MD yarns 32-42. Within the same weaving sequence, each CMD yarn 61-72 also interweaves in an "over 5/under 1" pattern with the bottom MD yarns 51-56. This is exemplified by CMD yarn 66, which passes above bottom MD yarns 51 and 52, below bottom MD yarn 53, and above bottom MD yarns 54-56 (bottom yarns 51, 52 and 54-56 are consecutive in adjoining repeat units and combine to form the "over 5 portion of the CMD yarn sequence). In the embodiment illustrated in FIGS. 5A-5L, each CMD yarn, after passing over a top MD yarn, follows one of two paths. In the case of CMD yarns 61, 63, 65, 67, 69, 71, each of these CMD yarns passes under the next five adjacent top MD yarns and over the next two adjacent bottom MD yarns before passing below a bottom MD yarn as part of the weaving pattern. Thus, CMD yarn 61 passes over top MD yarn 32, then passes below top MD yarns 33-37 as it passes over bottom MD yarns 52 and 53, then passes below bottom MD yarn 54 before passing above the remaining bottom MD yarns and the below the remaining top MD yarns. In the case of CMD yarns 62, 64, 66, 68, 70, 72, each of these CMD yarns passes below the next four top MD yarns and the next two bottom CMD yarns before passing below a bottom MD yarn. Thus, CMD yarn 66 passes over top MD yarn 31, below top MD yarns 32-35 as it passes over bottom MD yarns 51 and 52, then passes below bottom MD yarn 53 before passing above the remaining bottom MD yarns and below the remaining top MD yarns. The offset between adjacent CMD yarns is between 3 and 7 top MD yarns, with the offset typically being an odd number of top MD yarns.

Returning now to FIG. 3, it can be observed that the top surface of the fabric 22 includes long MD floats ("floats" are segments of yarns that pass either entirely over or entirely under multiple adjacent perpendicular yarns; therefore, "MD floats" are segments of MD yarns that pass either entirely over or under multiple adjacent CMD yarns). As used herein, "long MD floats" are MD floats that pass over or under at least five consecutive CMD yarns. "Long paper side MD floats" are long MD floats that pass over at least five consecutive CMD yarns on the papermaking surface, and "long machine side MD floats" are MD floats that pass under at least five consecutive CMD yarns on the machine surface of the fabric.

The use of the base fabric 22 in the felt 14 can provide a desirable balance of properties. Felts with such base fabrics can exhibit sound sheet quality and consistent operability. The long paper side MD floats can provide uniform pressure support to the paper sheet, which can result in improved sheet quality and high drainage performance. On the machine side of the fabric, long MD floats can reduce the effect of "false air" during dewatering of the felt and paper sheets over suction rolls and suction boxes, which can in turn increase drainage and enhance conditioning of the felt. Because the long floats are bound to the base fabrics, they tend to resist collapse (unlike non-woven designs), and long MD floats on the paper side of the fabric provide relatively few knuckles that can cause marking of the paper sheet.

Figure 6:
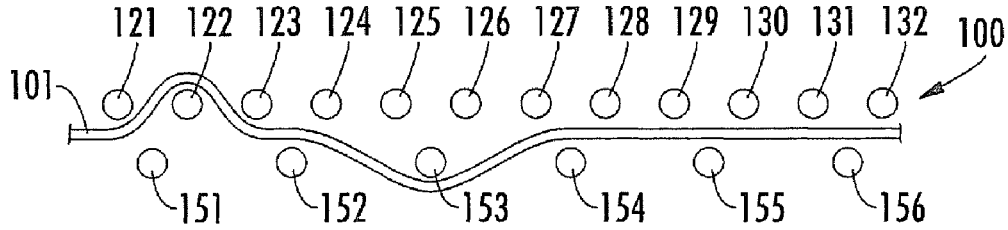
FIG. 6 is a section view of a base fabric according to alternative embodiments of the present invention.

Other duplex fabrics having long MD floats may also be suitable for use with the present invention. For example, FIG. 6 illustrates a typical CMD yarn 101 for use in a duplex fabric 100. The fabric 100 differs from the fabric 22 in the interweaving of the CMD yarns with the top and bottom MD yarns. As illustrated in FIG. 6, CMD yarn 101 passes over a top MD yarn 122, then passes under three top MD yarns 123-125 and over one bottom MD yarn 152 before passing under bottom MD yarn 153. CMD yarn 101 then passes above bottom MD yarns 154-156 and 151 and below MD yarns 126-132 and 121. As with the fabric 22, the offset between adjacent CMD yarns is typically between three and seven top MD yarns.

Figure 7:
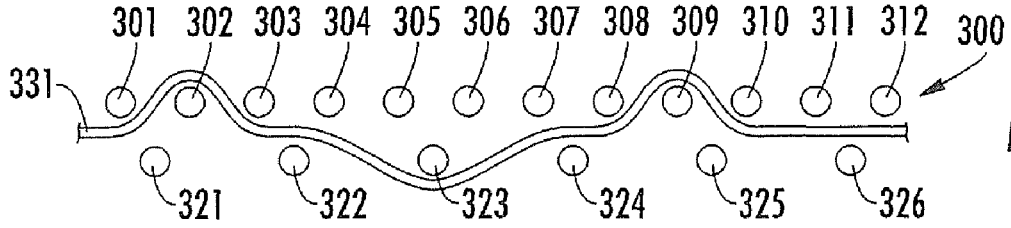
FIG. 7 is a section view of a base fabric according to alternative embodiments of the present invention.

A further embodiment of a duplex fabric that is suitable for use in press felts of the present invention is illustrated in FIG. 7 and designated broadly at 300. The fabric 300 includes twelve top MD yarns 301-312, six bottom MD yarns 321-326, and six CMD yarns (only one CMD yarn 331 is shown herein). Rather than following the "over 1/under 12" sequence of the embodiments of FIGS. 1-7, CMD yarn 331 of the fabric 300 weaves in an "over 1/under 6/over 1/under 4" sequence with top MD yarns 301-312, and in an "over 5/under 1" sequence with bottom MD yarns 321-326. In the illustrated embodiment, CMD yarn 331 passes below the bottom MD yarn 323 that is substantially "centered" between the paper side MD knuckles formed by the CMD yarn 331 over top MD yarns 302 and 309 (i.e., between paper side knuckles, CMD yarn 331 passes above one bottom MD yarn 322, below one bottom MD yarn 323, above one bottom MD yarn 324). Adjacent CMD yarns may be offset from each other in the manner described above for the embodiment of FIGS. 3-5L.

Figure 8:
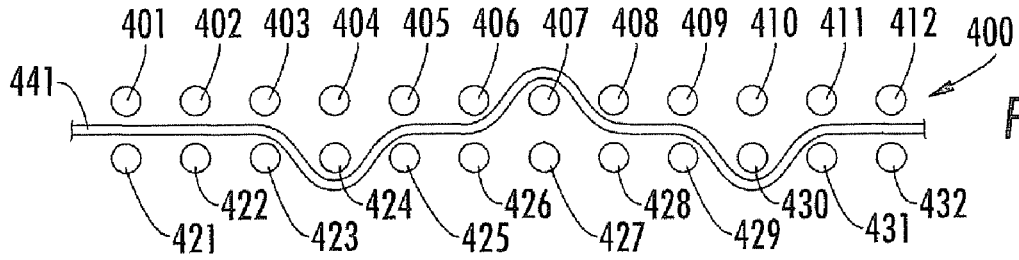
FIG. 8 is a section view of a base fabric according to alternative embodiments of the present invention.

FIG. 8 illustrates a duplex fabric 400 that includes twelve top MD yarns 401-412, twelve bottom MD yarns 421-432, and twelve CMD yarns (only one CMD yarn 441 is illustrated herein). CMD yarn 441 interweaves with top MD yarns 401-412 in an "over 1/under 11" sequence and with bottom MD yarns 421-432 in an "over 5/under 1/over 5/under 1" sequence. As can be seen in FIG. 8, the paper side knuckle formed by CMD yarn 441 as it passes over top MD yarn 407 is substantially centered between the machine side knuckles formed as CMD yarn 441 passes below bottom MD yarns 424 and 430. In this embodiment, adjacent CMD yarns may be offset from each other as described above.

Figure 9:
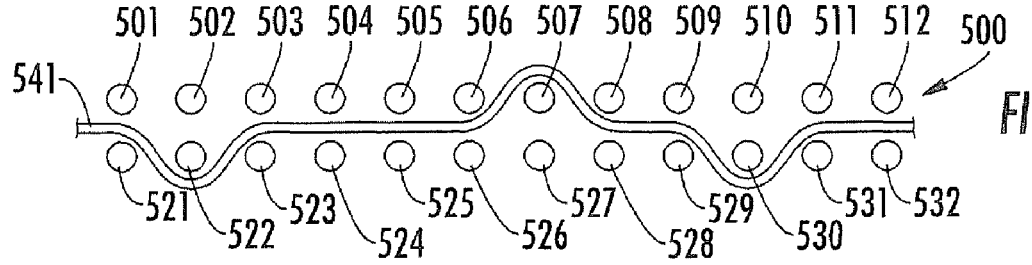
FIG. 9 is a section view of a base fabric according to alternative embodiments of the present invention.
Figure 10:
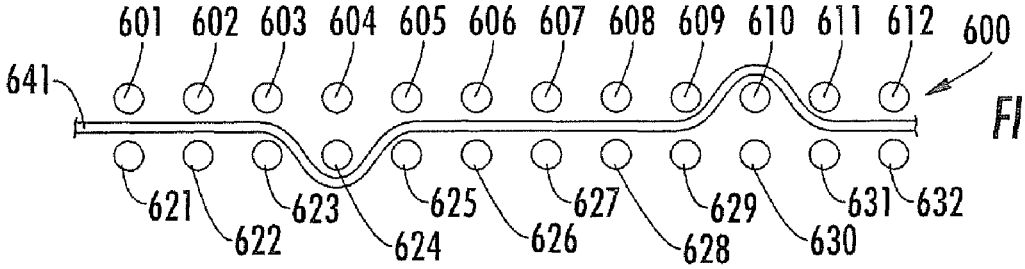
FIG. 10 is a section view of a base fabric according to alternative embodiments of the present invention.

Variations of the duplex fabric of FIG. 8 are illustrated in FIGS. 9 and 10. FIG. 9 illustrates a fabric 500 that includes twelve top MD yarns 501-512, twelve bottom MD yarns 521-532, and twelve CMD yarns (only one CMD yarn 541 is shown herein). CMD yarn 541 interweaves with the top MD yarns 501-512 in an "over 1/under 11" sequence and with the bottom MD yarns 521-532 in an "over 7/under 1/over 3/under 1" sequence. FIG. 10 illustrates a fabric 600 in which twelve CMD yarns (exemplified by CMD yarn 641) interweaves with top MD yarns 601-612 in an "over 1/under 11" sequence and with bottom MD yarns 621-632 in an "over 11/under 1" sequence. In these embodiments, adjacent CMD yarns may be offset from one another as described above.

Figure 11:
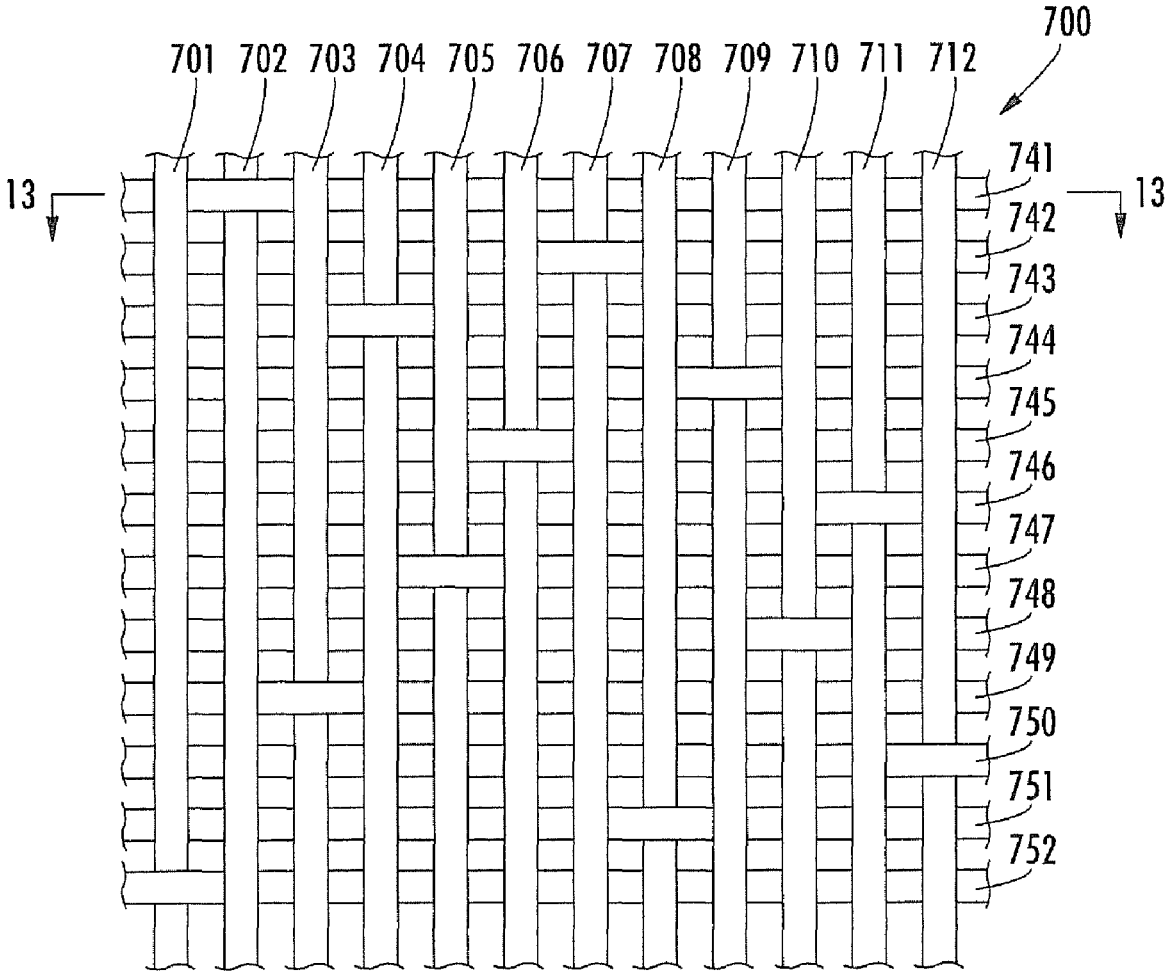
FIG. 11 is a top view of a triple layer base fabric according to alternative embodiments of the invention.
Figure 12:
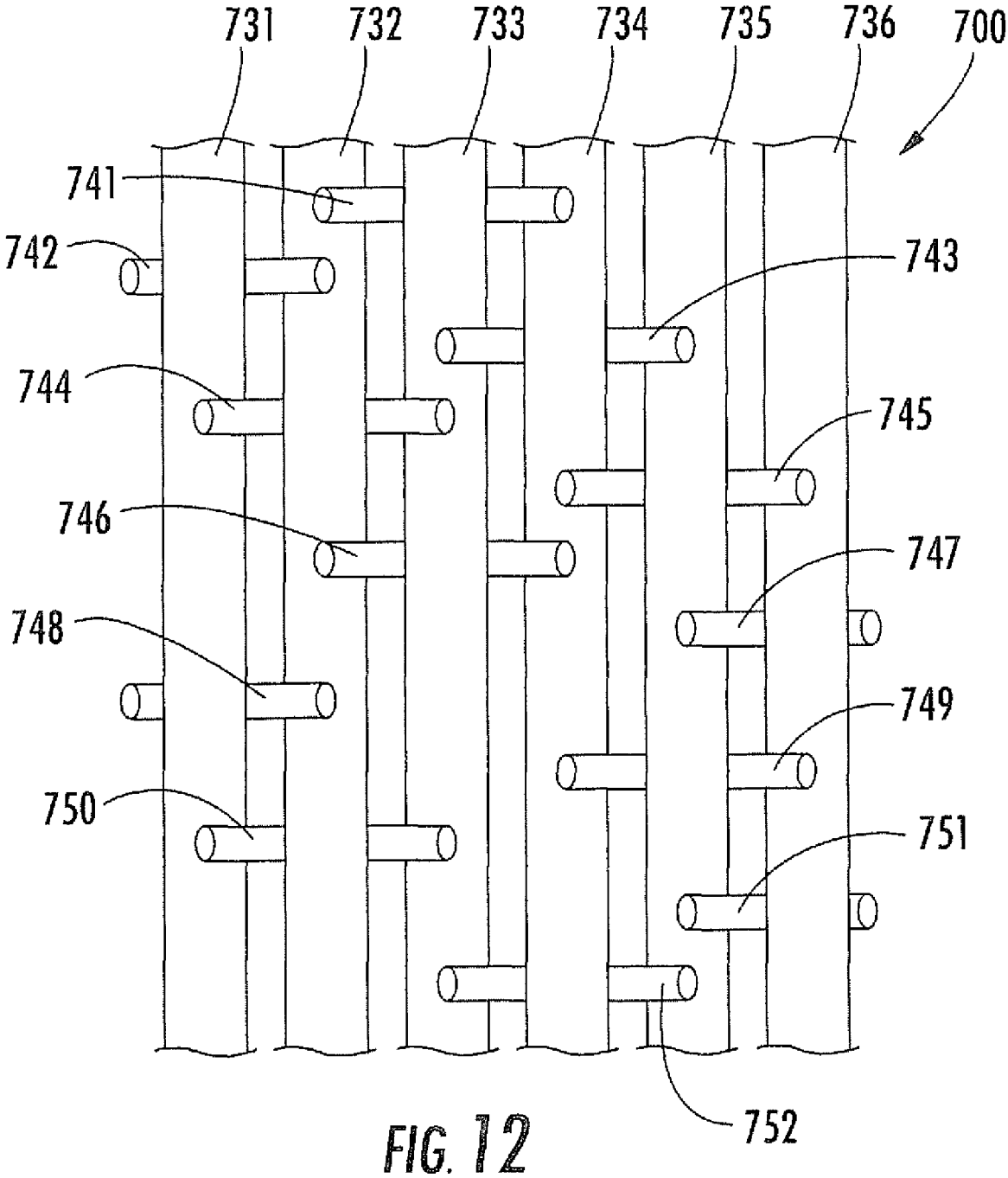
FIG. 12 is a top view of the bottom layer of the fabric of FIG. 11.
Figure 13:
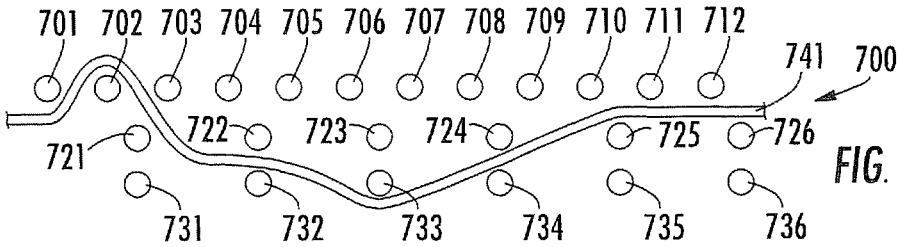
FIG. 13 is a section view of the base fabric taken along lines 13-13 of FIG. 11.

In addition to the duplex fabrics illustrated in FIGS. 3-10, press felts of the present invention may also employ triplex fabrics. An example of one such triplex fabric is illustrated in FIGS. 11-13 and designated broadly at 700. The fabric 700 includes twelve top MD yarns 701-712, six intermediate MD yarns 721-726, six bottom MD yarns 731-736, and twelve CMD yarns 741-752. Each CMD yarn interweaves with the top MD yarns 701-712 in an "over 1/under 11 pattern", and with the bottom MD yarns 731-736 in an "over 5/under 1" pattern. As can be seen in FIG. 13, CMD yarn 741 interweaves with the intermediate MD yarns 721-726 in an "over 3/under 3" sequence, with CMD yarn 741 interweaving with a top MD yarn (top MD yarn 702 in FIGS. 11 and 13) as it passes over intermediate yarns 725, 726, 721 and interweaving with a bottom MD yarn (bottom MD yarn 733 in FIGS. 11 and 13) as it passes below intermediate yarns 722-724). In an alternative but similar fabric 800 shown in FIG. 14, after passing above top MD yarn 802, CMD yarn 841 passes above only one intermediate yarn 822 before passing below intermediate MD yarns 823-825 and interweaving below bottom MD yarn 834 (CMD yarn 841 also passes below top MD yarns 803-812 and 801, above bottom MD yarns 831-833 and 835-836, and above intermediate MD yarns 826 and 821). For both of these fabric embodiments, adjacent CMD yarns may be offset from each other as described above.

Figure 14:
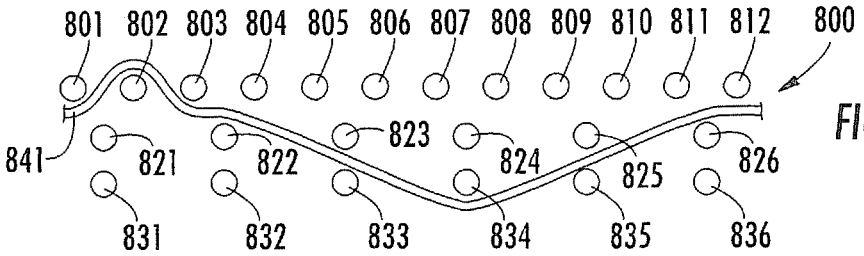
FIG. 14 is a section view of a base fabric according to alternative embodiments of the present invention.
Figure 15:
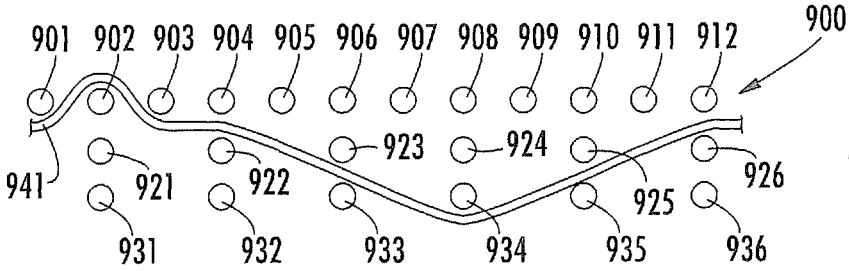
FIG. 15 is a section view of a base fabric according to alternative embodiments of the present invention.

It should be noted in FIG. 14 that the intermediate MD yarns 821-826 and bottom MD yarns 831-836 are vertically stacked (i.e. each intermediate MD yarn 821-826 is positioned directly above a corresponding bottom MD yarn 831-836), and that these stacks of yarns are positioned between two top MD yarns 801-812. FIG. 15 illustrates a fabric 900 in which CMD yarn 941 has the identical interweaving sequence as the fabric 800 of FIG. 14, but the intermediate MD yarns 921-926 and the bottom MD yarns 931-936 are not only vertically stacked with each other, but also are vertically stacked below a corresponding top MD yarn 901-912. Those skilled in this art will appreciate that a fabric may be woven that follows the weaving pattern of fabric 700 with the intermediate and bottom MD yarns vertically stacked below a corresponding top MD yarn, or other fabric embodiments may be woven in which the intermediate and bottom MD yarns are not vertically stacked.

Figure 18:
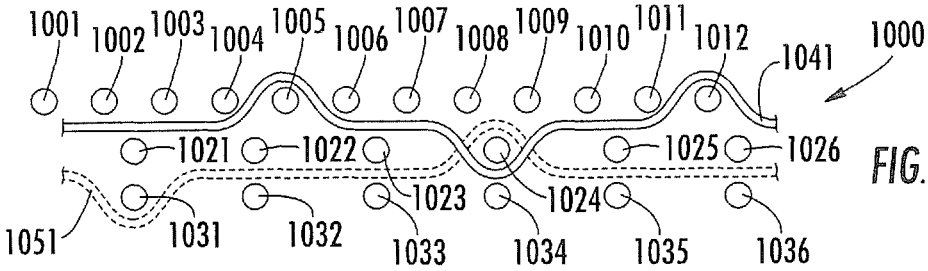
FIG. 18 is a section view of the base fabric of FIG. 16 taken along lines 18-18 thereof.
Figure 16:
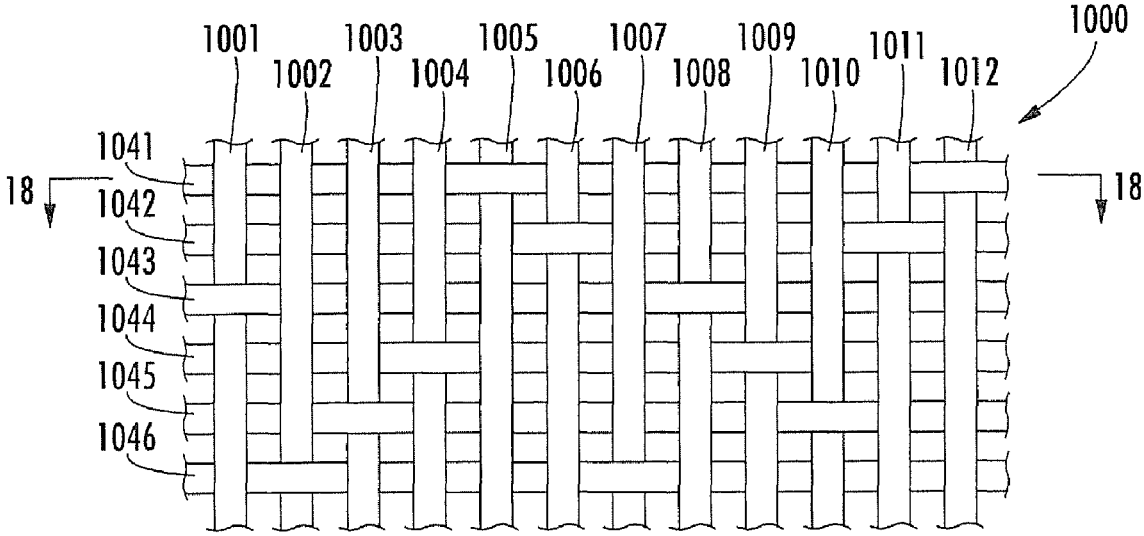
FIG. 16 is a top view of a triple layer base fabric according to alternative embodiments of the invention.
Figure 17:
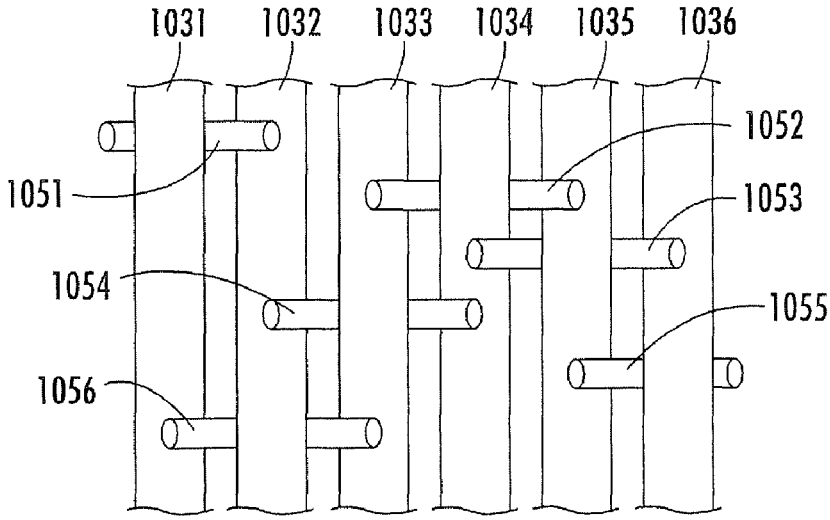
FIG. 17 is a top view of the bottom layer of the fabric of FIG. 16.

FIGS. 16-18 illustrate an additional triplex fabric designated broadly therein at 1000. The fabric 1000 includes twelve top MD yarns 1001-1012, six intermediate MD yarns 1021-1026, six bottom MD yarns 1031-1036, six upper CMD yarns 1041-1046, and six lower CMD yarns 1051-1056. Each upper CMD yarn 1041-1046 interweaves with the top MD yarns 1001-1012 in an "over 1/under 6/over 1/under 4" sequence, and further interweaves with the intermediate MD yarns in an "over 5/under 1" sequence. In the illustrated embodiment, the intermediate MD yarn 1024 under which the upper CMD yarn 1041 weaves is "centered" between the top side knuckles formed by the upper CMD yarn 1041 as it passes over top MD yarns 1005, 1012 (the intermediate and bottom MD yarns are vertically stacked with one another, but are located in interstices between the top MD yarns). In addition, lower CMD yarn 1051 interweaves with the intermediate MD yarns 1021-1026 in an "over 1/under 5" sequence and with the lower MD yarns 1031-1036 in an "over 5/under 1" sequence. The lower CMD yarn 1051 forms a knuckle above the intermediate MD yarn 1024 that is offset by three intermediate MD yarns from the intermediate MD yarn 1021 that is directly above the bottom MD yarn 1031 under which the lower CMD yarn 1051 forms a machine side knuckle. Also, it should be noted that lower CMD yarn 1051 passes over the same intermediate yarn 1024 that the upper CMD yarn 1041 passes under. Adjacent upper and lower CMD yarns can be offset from each other as described above.

Figure 19:
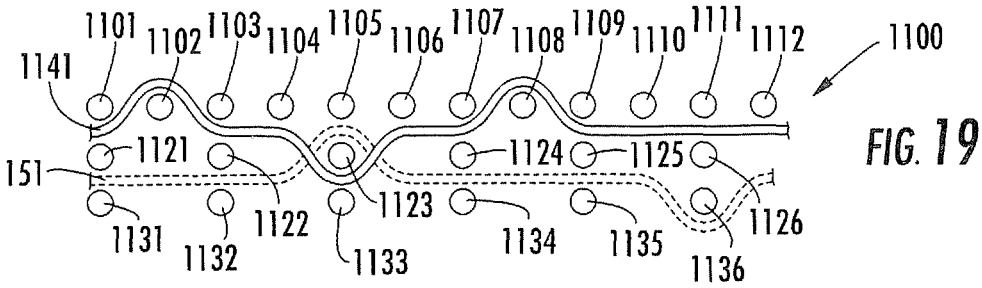
FIG. 19 is a section view of a base fabric according to alternative embodiments of the present invention.

Another fabric embodiment of the present invention is illustrated in FIG. 19 and is designated broadly therein at 1100. The fabric 1100 includes twelve top MD yarns 1101-1112, six intermediate MD yarns 1121-1126, six bottom MD yarns 1131-1136, six upper CMD yarns (only upper CMD yarn 1141 is shown in FIG. 19) and six lower CMD yarns (only lower CMD yarn 1151 is shown in FIG. 19). The fabric 1100 is very similar to the fabric 1000 illustrated in FIGS. 16-18; however, the intermediate and bottom MD yarns 1121-1126 and 1131-1136 are vertically stacked with each other and directly beneath a corresponding top MD yarn. Also, the upper CMD yarns (exemplified by lower CMD yarn 1141) interweave with the top MD yarns in an "over 1/under 5/over 1/under 5" sequence.

Figure 20:
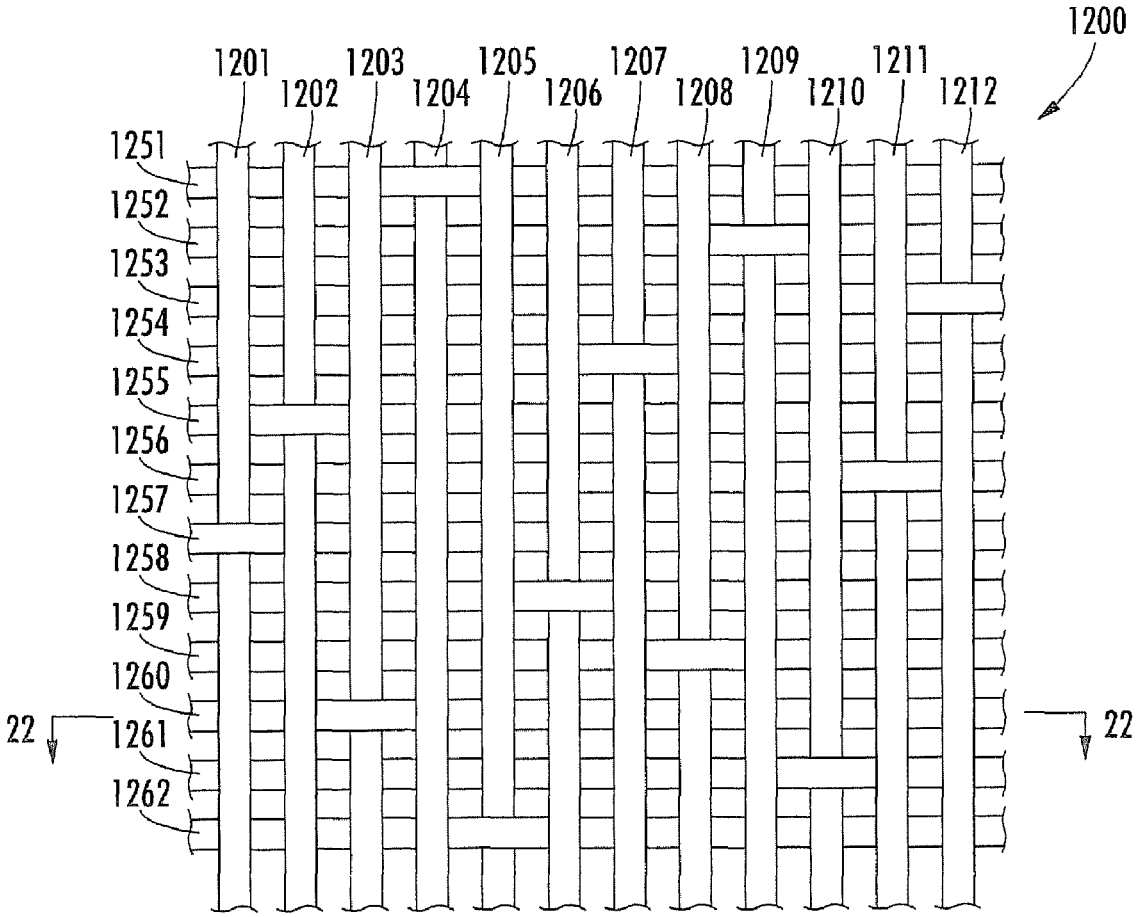
FIG. 20 is a top view of a triple layer base fabric according to alternative embodiments of the invention.
Figure 21:
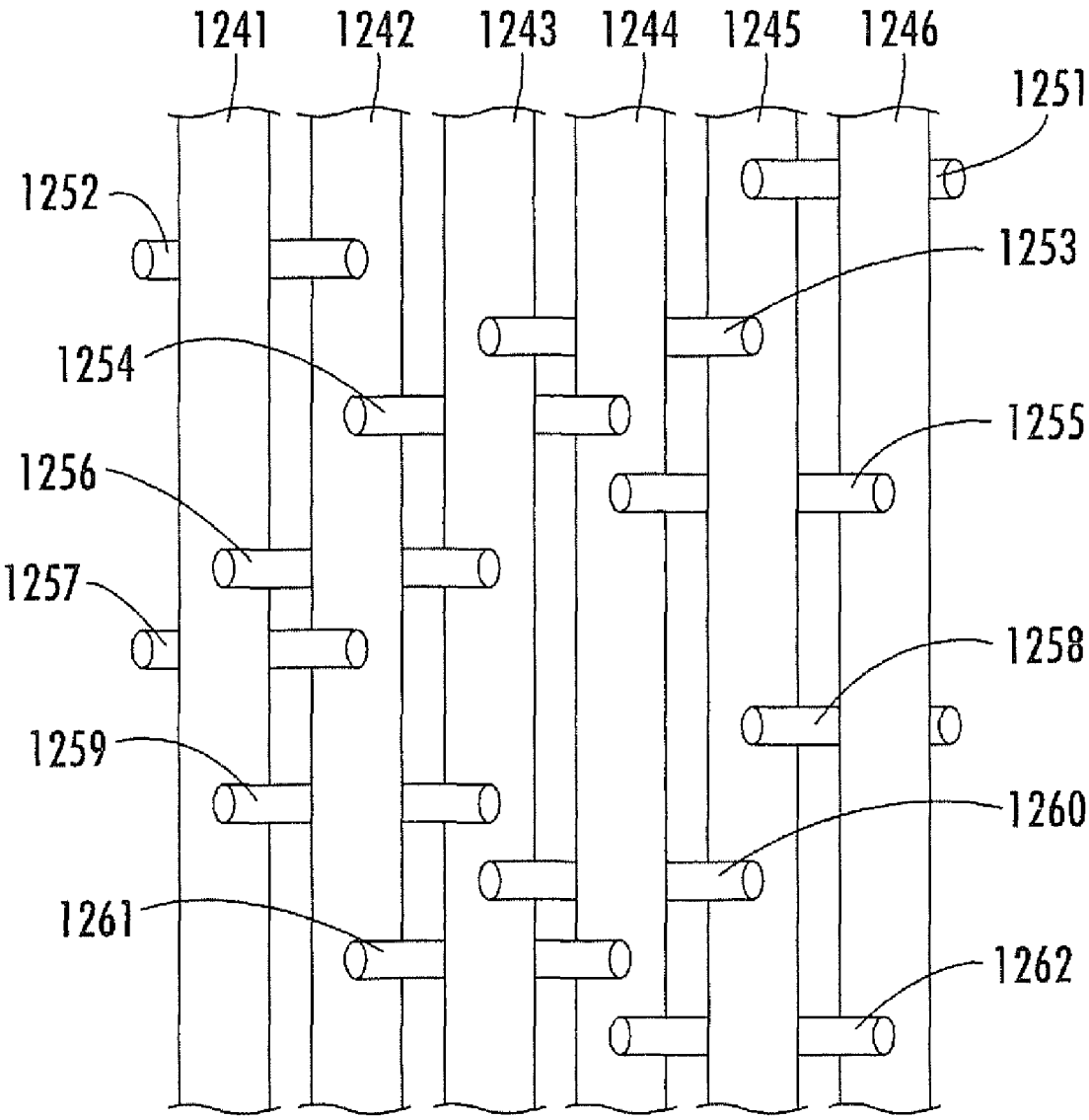
FIG. 21 is a top view of the bottom layer of the fabric of FIG. 20.
Figure 22:
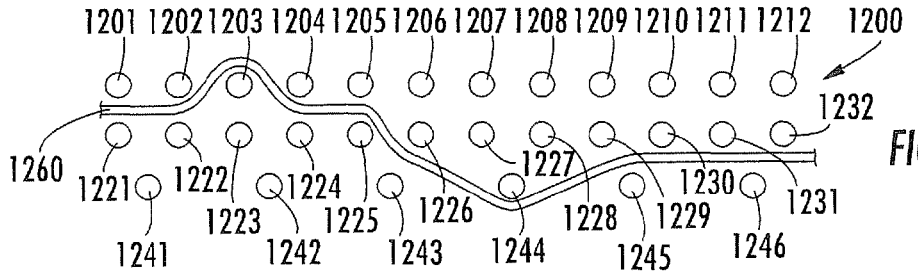
FIG. 22 is a section view of the base fabric of FIG. 20 taken along lines 22-22 thereof.

The triplex fabric embodiments of FIGS. 11-19 include equal numbers of intermediate and bottom MD yarns; however, fabric embodiments that have equal numbers of top and intermediate MD yarns are contemplated for use with the present invention. FIGS. 20-22 illustrate an embodiment of such a triplex fabric designated broadly at 1200. The fabric 1200 includes twelve top MD yarns 1201-1212, twelve intermediate MD yarns 1221-1232, six bottom MD yarns 1241-1246, and twelve CMD yarns 1251-1262. In this embodiment, the intermediate MD yarns 1221-1232 are vertically stacked beneath the top MD yarns 1201-1212. The CMD yarns interweave with the top MD yarns 1201-1212 in an "over 1/under 11" sequence, with the intermediate MD yarns 1221-1232 in an "over 7/under 5" sequence, and with the bottom MD yarns 1231-1236 in an "over 5/under 1" sequence. Referring to FIG. 22 as an example, after passing over top MD yarn 1203, CMD yarn 1260 passes over two intermediate MD yarns 1224, 1225; CMD yarn 1260 then passes below intermediate MD yarns 1226 and 1227 before passing below bottom MD yarn 1244. CMD yarn 1260 then passes below intermediate MD yarns 1228-1232 before passing above intermediate yarns 1221 and 1222 and traveling up to pass over top MD yarn 1203. In following this path, CMD yarn 1260 passes over bottom MD yarns 1241-1243 and 1245-1246.

Figure 23:
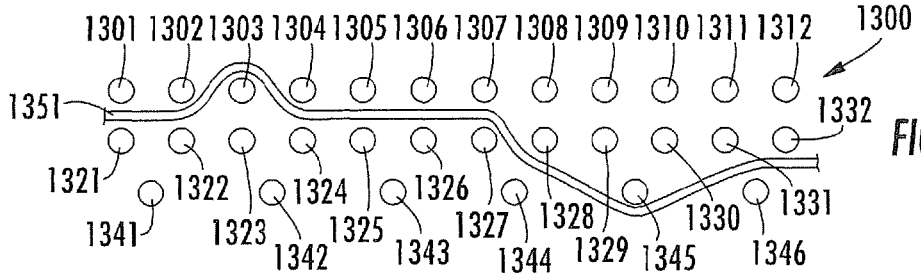
FIG. 23 is a section view of a base fabric according to alternative embodiments of the present invention.
Figure 24:
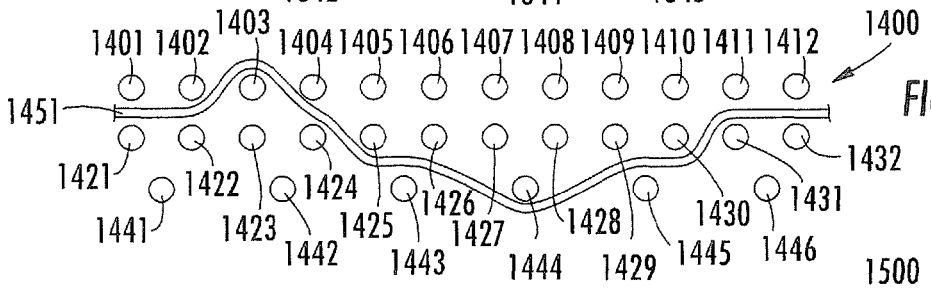
FIG. 24 is a section view of a base fabric according to alternative embodiments of the present invention.
Figure 25:
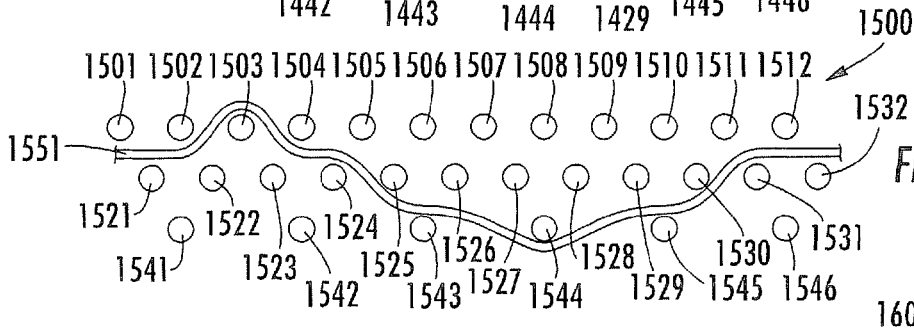
FIG. 25 is a section view of a base fabric according to alternative embodiments of the present invention.

Another triplex fabric embodiment, designated broadly at 1300, is illustrated in FIG. 23. Like the fabric 1200 described above, the fabric 1300 has twelve top MD yarns 1301-1312, twelve intermediate MD yarns 1321-1332, six bottom MD yarns 1341-1346, and twelve CMD yarns (only CMD yarn 1351 is shown in FIG. 17). The fabric 1300 varies from the fabric 1200 described above in the path that the CMD yarn 1351 follows: after passing above top MD yarn 1303, CMD yarn 1351 passes above four intermediate MD yarns 1324-1327 before passing below intermediate MD yarns 1328-1332 and bottom MD yarn 1345. FIG. 24 also depicts a similar fabric embodiment. The fabric 1400 shown therein has twelve top MD yarns 1401-1412, twelve intermediate MD yarns 1421-1432, six bottom MD yarns 1441-1446, and twelve CMD yarns (only CMD yarn 1451 is shown in FIG. 17). The fabric 1400 differs from the fabric 1300 in that CMD yarn 1451 follows an "over 6/under 6" sequence relative to the intermediate MD yarns. More specifically, CMD yarn 1451 passes above top MD yarn 1403, above one intermediate MD yarn 1424, below six intermediate MD yarns 1425-1430 as it passes below bottom MD yarn 1444, and passes above six intermediate MD yarns 1431, 1432, and 1421-1424 as it passes above top MD yarn 1403. FIG. 25 shows a very similar fabric 1500, in which the twelve intermediate MD yarns 1521-1532 are located below the interstices formed by top MD yarns 1501-1512 rather than being vertically stacked beneath them. Each of the bottom MD yarns 1541-1546 are vertically stacked below one of the top MD yarns 1501-1512. The CMD yarns (exemplified by CMD yarn 1551) follow the same interweaving pattern with the top, intermediate and bottom MD yarns as does CMD yarn 1451 in the fabric 1400.

Figure 28:
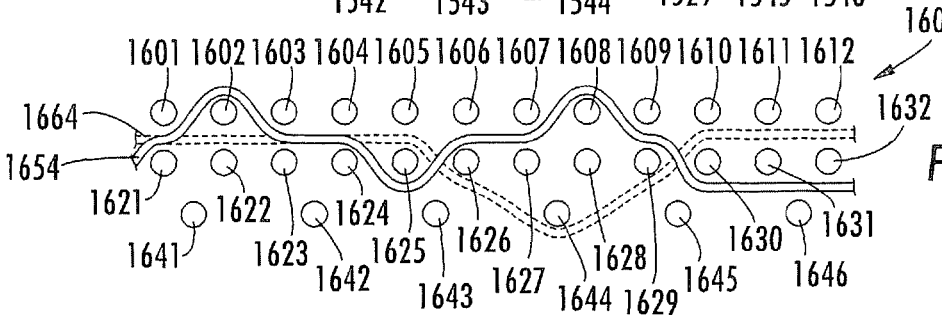
FIG. 28 is a section view of the base fabric of FIG. 26 taken along lines 28-28 thereof.
Figure 29:
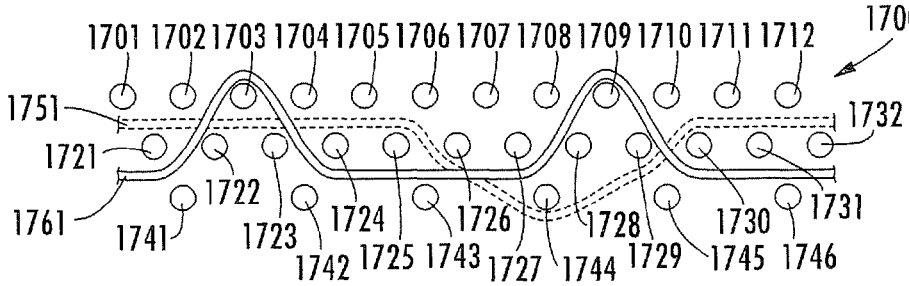
FIG. 29 is a section view of a base fabric according to alternative embodiments of the present invention.
Figure 26:
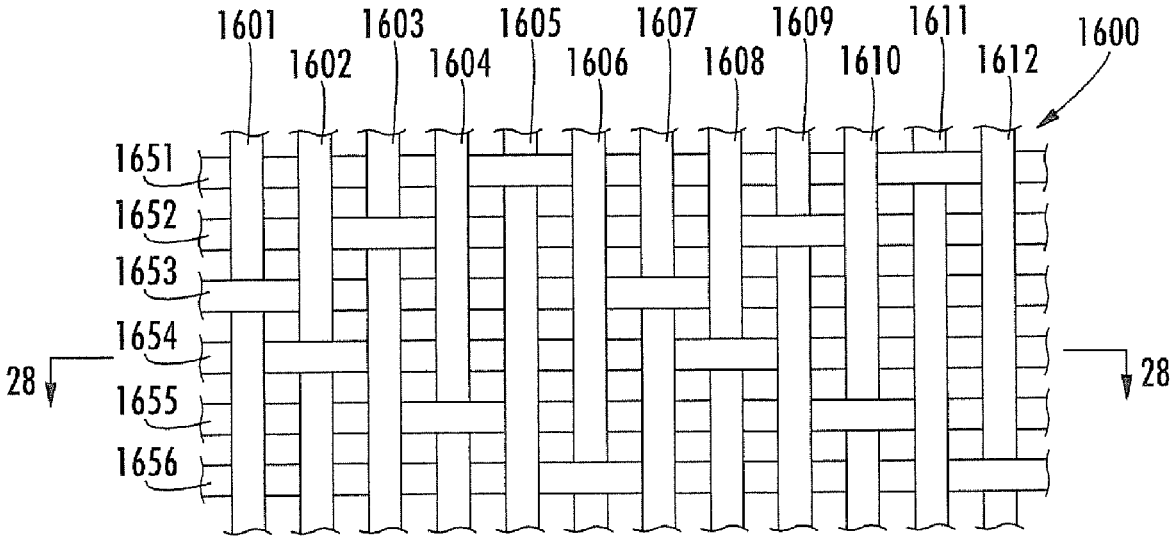
FIG. 26 is a top view of a triple layer base fabric according to alternative embodiments of the invention.
Figure 27:
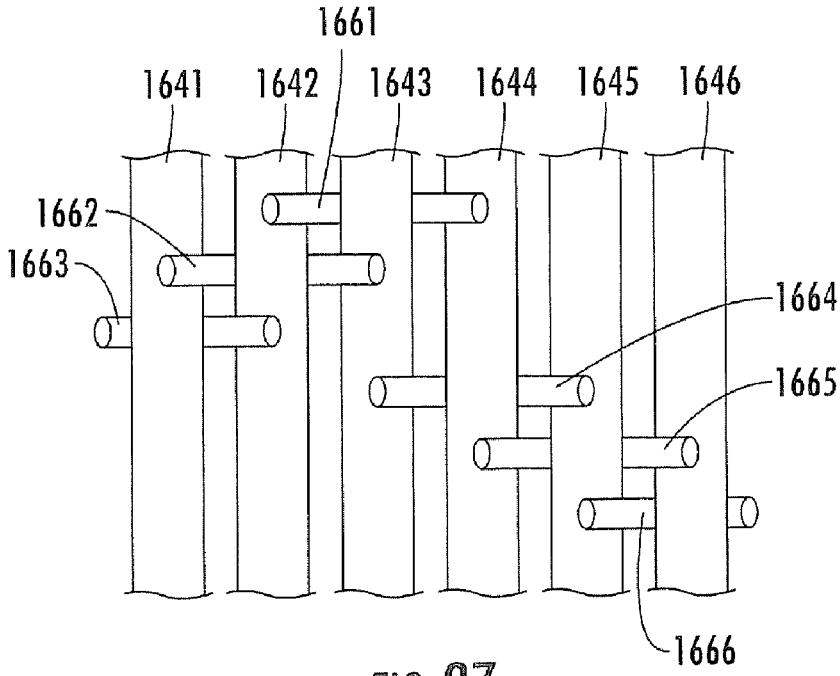
FIG. 27 is a top view of the bottom layer of the fabric of FIG. 26.

A further triplex fabric embodiment, designated broadly at 1600, is illustrated in FIGS. 26-28. The fabric 1600 includes twelve top MD yarns 1601-1612, twelve intermediate MD yarns 1621-1632, six bottom MD yarns 1641-1646, six upper CMD yarns 1651-1656, and six lower CMD yarns 1661-1666. Each upper CMD yarn follows an "over 1/under 5/over 1/under 5" sequence with the top MD yarns 1601-1612 and an "over 4/under 1/over 4/under 3" sequence with the intermediate MD yarns 1621-1632. Each lower CMD yarn follows an "over 8/under 4" sequence in interweaving with the intermediate MD yarns 1621-1632 and an "over 5/under 1" sequence relative to the bottom MD yarns 1641-1646. More specifically, as shown in FIG. 28, lower CMD yarn 1664 stitches below bottom MD yarn 1644, which is located in a interstice adjacent top MD yarn 1608 that upper CMD yarn 1654 passes over. A similar fabric embodiment, designated broadly at 1700, is illustrated in FIG. 29. The fabric 1700 also includes twelve top MD yarns 1701-1712, twelve intermediate MD yarns 1721-1732, six bottom MD yarns 1741-1746, six upper CMD yarns (only upper CMD yarn 1751 is shown in FIG. 29), and six lower CMD yarns (only lower CMD yarn 1761 is shown in FIG. 29). However, the upper CMD yarn 1751 interweaves with the intermediate MD yarns 1721-1732 in an "over 2/under 4/over 2/under 4" sequence, with the upper CMD yarn 1751 passing over the top MD yarns (in this instance top MD yarns 1703, 1709) that are located in the space above the two intermediate MD yarns in the two "over 2" segments referenced above. The lower CMD yarns follow the same pattern as for fabric 1600 above.

It should be noted that, for the fabric embodiments that are illustrated in and described with respect to FIGS. 16-19 and 26-29, these fabrics can be woven using two different warp beams. This enables two different CMD yarns to be woven to bind different; i.e., the upper CMD yarns can weave the top and intermediate MD yarns and the lower CMD yarns can weave the intermediate and bottom MD yarns. This configuration can also allow different yarn types to be used for the upper and lower CMD yarns dependent on the desired properties of the fabric.

It can be seen that each of the fabric embodiments illustrated and described with respect to FIGS. 6-29 have long MD floats. As such, each may provide the type of performance advantages discussed above in connection with the fabric 22 of FIGS. 3-5L. Also, other base fabrics of different weave patterns having long MD floats may also be employed with the present invention, whether they be duplex, triplex, or quadruplex fabrics.

Typically, the yarns employed in the base fabrics described above may be of any form (e.g., monofilament, multifilament, hybrid yarns, meltable monofilaments, and twists) known to be suitable for use in press felts, although monofilaments or twists are preferred. For the CMD yarns, 3- or 4-ply twisted monofilaments may be particularly suitable (especially 0.1 to 0.3 mm twisted monofilaments), as may monofilaments up to 1.0 mm, spun yarns, multifilaments, core-wrapped yarns or combinations thereof. MD yarns are typically twisted monofilaments, but monofilaments up to 1.0 mm, spun yarns, multifilaments, core-wrapped yarns and combinations may also be particularly suitable for use in the base fabrics of press felts of the invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A papermaker's press felt, comprising:

an endless woven base fabric, comprising:

a set of top machine direction (MD) yarns;

a set of intermediate MD yarns;

a set of bottom MD yarns;

a set of upper cross machine direction (CMD) yarns interwoven with the top MD yarns and the intermediate MD yarns; and a set of lower CMD yarns interwoven with the intermediate MD yarns and the bottom MD yarns;

the press felt further comprising at least one batt layer attached to the base fabric;

wherein the upper and lower CMD yarns of the fabric are woven from two different warp beams, the upper CMD yarns from a first warp beam being of a first type, and the lower CMD yarns from a second warp beam being of a second type that is different from the first type.

2. The press felt defined in claim 1, wherein the bottom MD yarns are not vertically stacked beneath the top MD yarns.

3. The press felt defined in claim 2, wherein the intermediate MD yarns are not vertically stacked beneath the top MD yarns.

4. The press felt defined in claim 1, wherein adjacent bottom and top CMD yarns interweave with the same intermediate MD yarn.

5. The press felt defined in claim 1, wherein each of the upper CMD yarns forms two paper side knuckles in the repeat unit.

6. The press felt defined in claim 1, wherein each of the lower CMD yarns forms only one machine side knuckle in the repeat unit.

7. The press felt defined in claim 1, wherein the set of intermediate MD yarns and the set of bottom MD yarns include the same numbers of yarns.

8. The press felt defined in claim 1, wherein the set of intermediate MD yarns and the set of top MD yarns include the same numbers of yarns.

9. The press felt defined in claim 1, wherein the top MD yarns form long paper side floats above certain consecutive ones of the top CMD yarns.

10. A method of producing a papermaker's press felt, comprising the steps of:

(a) endless weaving a base fabric, the base fabric including:

a set of top machine direction (MD) yarns;

a set of intermediate MD yarns;

a set of bottom MD yarns;

a set of upper cross machine direction (CMD) yarns interwoven with the top MD yarns and the intermediate MD yarns; and a set of lower CMD yarns interwoven with the intermediate MD yarns and the bottom MD yarns;

wherein the upper CMD yarns are woven using a first warp beam of a loom, and the lower CMD yarns are woven using a second warp beam of the loom, the second warp beam being different than the first warp beam; and (b) needling a batt layer onto the base fabric to form a press felt;

wherein the upper CMD yarns are of a first type, and the lower CMD yarns are of a second type that differs from the first type.

11. The method defined in claim 10, wherein the intermediate MD yarns are not vertically stacked beneath the top MD yarns.

12. The method defined in claim 10, wherein adjacent bottom and top CMD yarns interweave with the same intermediate MD yarn.

* * * * *